US007265725B2

(12) United States Patent
Nakajima et al.

(10) Patent No.: US 7,265,725 B2
(45) Date of Patent: Sep. 4, 2007

(54) ANTENNA DEVICE

(75) Inventors: Nana Nakajima, Aichi (JP); Hiroaki Kojima, Aichi (JP)

(73) Assignees: Kabushiki Kaisha Tokai-Rika-Denki-Seisakusho, Aichi-ken (JP); Toyota Jidosha Kabushiki Kaisha, Aichi-ken (JP)

( * ) Notice: Subject to any disclaimer, the term of this patent is extended or adjusted under 35 U.S.C. 154(b) by 35 days.

(21) Appl. No.: 11/385,818

(22) Filed: Mar. 22, 2006

(65) Prior Publication Data

US 2006/0214861 A1 Sep. 28, 2006

(30) Foreign Application Priority Data

Mar. 24, 2005 (JP) ..... 2005-086703

(51) Int. Cl.
*H01Q 1/32* (2006.01)

(52) U.S. Cl. ..... 343/713; 343/872; 343/711

(58) Field of Classification Search ..... 343/713
See application file for complete search history.

(56) References Cited

U.S. PATENT DOCUMENTS

2005/0237249 A1* 10/2005 Nagel ..... 343/713
2006/0214862 A1* 9/2006 Hiroe et al. ..... 343/713
2006/0262024 A1* 11/2006 Donald ..... 343/793

FOREIGN PATENT DOCUMENTS

JP 10-16646 1/1998
JP 11-254925 9/1999

* cited by examiner

*Primary Examiner*—Trinh Vo Dinh
(74) *Attorney, Agent, or Firm*—Roberts, Mlotkowski & Hobbes; Thomas W. Cole

(57) ABSTRACT

A cutout portion through which one end side of a U-shaped portion of the antenna passes is cut deeper than a preset passing position where the U-shaped portion passes through the cutout portion. Further, an open dimension of a through hole through which the other end side of the U-shaped portion passes is substantially twice an outer diameter dimension of the U-shaped portion. When the U-shaped portion is passed through the through hole at the preset passing position, the U-shaped portion passes through the substantial center of the through hole. When error arises in the retention position of the antenna and the fixing position of the base plate, the U-shaped portion is displaced inside the cutout portion and the through hole, and the above error is absorbed.

12 Claims, 4 Drawing Sheets

ANTENNA DEVICE

CROSS-REFERENCE TO RELATED APPLICATION

This application claims priority under 35 USC 119 from Japanese Patent Application No. 2005-86703, the disclosure of which is incorporated by reference herein.

BACKGROUND OF THE INVENTION

1. Field of the Invention

The present invention relates to an antenna device that transmits or receives radio waves with an antenna.

2. Description of the Related Art

For example, in the tire pressure monitoring system (TPMS) disclosed in Japanese Patent Application Publication (JP-A) No. 11-254925, the air pressure of tires is detected by detecting means disposed inside the tires. An electrical signal corresponding to the detection result is outputted from the detecting means, and a wireless signal corresponding to the level of the electrical signal is outputted from transmitting means.

The wireless signal outputted from the transmitting means is received by receiving means, and an electrical signal corresponding to the level of the received wireless signal is outputted from the receiving means. The electrical signal outputted from the receiving means is inputted to a control unit disposed in the vehicle. When the control unit determines that the air pressure of the tires is equal to or less than a predetermined value on the basis of the level of the inputted electrical signal, the control unit activates an alarm device and informs the passenger of the vehicle with an alarm.

The receiving means for receiving the wireless signal transmitted inside and outside the vehicle is disposed with an antenna device for substantially receiving the wireless signal, and an example thereof is disclosed in JP-A No. 10-16646. The antenna device is configured to include a rod-like antenna whose leading end side is formed in a coil and a circuit board including an electrical circuit connected to a power supply and a ground. The base end side of the antenna is electrically and mechanically connected to the electrical circuit of the circuit board.

The antenna device disclosed in JP-A No. 10-16646 is disposed inside an inner mirror attached to the inside of the vehicle cabin. In contrast, the wireless signal transmitting means is disposed outside the vehicle cabin (e.g., inside the tires) because the tire pressure monitoring system monitors the air pressure of the tires. For this reason, it is preferable to dispose a receiving antenna device outside the vehicle cabin in order to receive the wireless signal from the transmitting means. As is also suggested in JP-A No. 11-254925, the inside of a visor configuring a door mirror of the vehicle is considered as a candidate for the position where the receiving antenna device may be disposed.

When the antenna device is disposed outside the vehicle cabin, including the inside of the visor of the door mirror, the antenna and the circuit board are housed inside a case in a state where the base end side of the antenna is soldered to the circuit board in order to prevent water from adhering to the circuit board and the antenna when it rains or when the vehicle is washed, and the case is fixed to a predetermined site on the vehicle.

When the antenna and the circuit board are housed inside a case in this manner, a retaining protrusion or the like for retaining the antenna is formed inside the case and the circuit board is screwed to a predetermined site in the case in order to prevent inadvertent displacement (movement) of the antenna and the circuit board inside the case.

Here, when the antenna and the circuit board are attached to the inside of the case, error arises in the relative positional relationship between the antenna and the circuit board inside the case due to error in the position of the retaining protrusion and screwed portion inside the case, dimensional error of the antenna, and error in the positions of a hole formed in the circuit board in order to insert a screw when the circuit board is screwed to the case.

Unnecessary force (stress) acts on the antenna when such error arises because the base end side of the antenna is fixed to the circuit board with solder. When such force acts on the antenna and deformation arises in the antenna, the characteristics of the antenna fluctuate.

Further, when tension or the like acts on the solder connecting the antenna and the circuit board due to such error, cracks arise in the solder.

SUMMARY OF THE INVENTION

In view of these circumstances, it is an object of the present invention to obtain an antenna device that can maintain the connection between the base plate and the antenna without unnecessary force (stress) being applied to the antenna and the portion where the antenna and the base plate are connected.

A first aspect of the invention provides an antenna device comprising: an antenna including a body portion that transmits or receives radio waves and a rod-like connecting portion that is contiguous with the body portion; and a base plate disposed with an electrical circuit on at least one of its surface and undersurface, wherein a penetrating portion through which the connecting portion passes is formed in the base plate in the thickness direction of the base plate, the penetrating portion has an open dimension that is larger than an outer diameter dimension of the connecting portion along a direction moving toward and away from the body portion, and the connecting portion passed through the penetrating portion is electrically connected to the electrical circuit by solder at the surface or the undersurface of the base plate.

In the antenna device pertaining to the first aspect of the invention, the base end side of the antenna is electrically connected to the electrical circuit formed on at least one of the surface and undersurface of the base plate. The electrical circuit is further connected to a power supply and a ground. Electrical power is supplied to the electrical circuit, whereby the antenna receives radio waves, or radio waves are transmitted from the antenna.

In the antenna device pertaining to the invention, the connecting portion of the antenna formed in a rod-like shape is electrically connected to the electrical circuit on the base plate by solder applied to the penetrating portion formed in the base plate, in a state where the connecting portion passes through (penetrates) the penetrating portion. Here, the open dimension of the penetrating portion along the direction in which the base plate moves toward and away from the body portion of the antenna is sufficiently larger than the outer diameter dimension of the connecting portion of the antenna.

Consequently, the connecting portion of the antenna can be displaced inside the penetrating portion when both the antenna and the base plate are positioned in a state where the connecting portion penetrates the penetrating portion. For this reason, when both the antenna and the base plate are being positioned, even if the base plate is moved with respect to the antenna in the direction moving toward and away from the body portion, the connecting portion does not become deformed because the connecting portion is displaced (moves) inside the penetrating portion. Thus, stress is not applied to the connection portion, and therefore the antenna, and the characteristics of the antenna are not affected.

Moreover, cracks and the like do not arise in the solder because the solder is applied to the penetrating portion in a state where both the antenna and the base plate have been positioned in this manner and the connecting portion is connected to the electrical circuit disposed on the base plate.

The antenna device pertaining to the first aspect of the invention may be configured to include a case that internally houses both the base plate and the antenna and includes a positioning portion that engages with and positions the antenna.

In the antenna device having this configuration, both the antenna and the base plate are housed inside the case. Here, the antenna is positioned inside the case by the positioning portion disposed inside the case. Consequently, the case is positioned at a site where the antenna device is to be attached, whereby the antenna is positioned with respect to the site where the antenna device is to be attached.

Here, in this configuration, the antenna is positioned inside the case as described above, and the connecting portion of the antenna is connected to the electrical circuit on the base plate by solder. However, as described above, the open dimension of the penetrating portion along the direction where the base plate moves toward and away from the body portion of the antenna is sufficiently larger than the outer diameter dimension of the connecting portion of the antenna.

For this reason, even when the connecting portion of the antenna penetrates the penetrating portion of the base plate in a state where the positioning portion of the case has engaged with the body portion of the antenna, the connecting portion penetrates the penetrating portion at the position of the connecting portion of the positioned antenna. Thus, when the connecting portion penetrates the penetrating portion, stress is not applied to the antenna including the connecting portion, and cracks and the like do not arise in the solder when the connecting portion and the electrical circuit on the base plate are connected by solder.

The antenna device pertaining to the first aspect of the invention may be configured such that the connecting portion includes a site that is bent or curved in a U-shape opening in the thickness direction of the base plate, with the connecting portion being contiguous with the body portion at one end side of the site, the base plate includes a cutout portion that opens at the body portion side of the outer peripheral portion of the base plate and penetrates the thickness direction of the base plate, with the cutout portion having a dimension along the direction moving toward and away from the body portion that is sufficiently larger than the outer diameter dimension of the connecting portion, and with the one end side of the site passing through the cutout portion, and a through hole that penetrates the thickness direction of the base plate and through which the other end side of the site passes from the undersurface side, with the through hole having an open dimension from the one end to the other end of the site that is sufficiently larger than the outer diameter dimension of the connecting portion, and the penetrating portion includes the through hole.

In the antenna device pertaining to this configuration, the connecting portion of the antenna is formed in a U-shape opening in the thickness direction of the base plate.

Further, the cutout portion and the through hole serving as the penetrating portion are formed in the base plate. The cutout portion opens at the outer peripheral portion of the base plate at the body portion side of the antenna, and in a state where the base plate has been attached to the antenna, the one end side (i.e., the side connected to the body portion of the antenna) of the connecting portion formed in the U-shape passes through the cutout portion. Moreover, the other end side of the connecting portion formed in the U-shape passes through the through hole from the underside of the base plate.

Here, the dimension of the cutout portion along its open dimension (depth dimension from the open end at the outer peripheral portion) is sufficiently larger than the outer diameter dimension of the connecting portion, and the open dimension of the through hole parallel to the surface of the base plate and from the one end to the other end of the connecting portion is sufficiently larger than the outer diameter dimension of the connecting portion.

For this reason, even when the base plate is moved in the open direction of the cutout portion and the opposite direction (i.e., the direction moving toward and away from the body portion of the antenna) in a state where the connecting portion penetrates both the cutout portion and the through hole, stress is not applied to the antenna including the connecting portion, and cracks and the like do not arise in the solder when the connecting portion and the electrical circuit on the base plate are connected by solder.

Because the antenna device has the structure described above, when the connecting portion is to be passed through the through hole, the base plate can be moved toward the connecting portion from the open side of the U-shaped connecting portion, and the connecting portion can be passed through the through hole. For this reason, the base plate can be easily set from the open side of the case in a state where the antenna has already been set in the case.

Moreover, with this configuration, when the electrical circuit on the base plate and the connecting portion are to be joined together with solder, it suffices for the solder to be applied to the end portion of the connecting portion protruding at the surface of the base plate from the through hole in the base plate. Consequently, as described above, the solder can be applied in a state where the antenna and the base plate have been disposed inside the case. Thus, the work of applying the solder becomes easy.

Moreover, in the antenna device pertaining to the invention, the solder is applied to the other end side of the connecting portion penetrating the through hole and not to the one end side of the connecting portion penetrating the cutout portion. Although the solder can also be applied to the portion penetrating the cutout portion, it is difficult to precisely apply the solder; for example, it becomes easy for the molten solder to flow toward the open side of the cutout portion (i.e., toward the outer peripheral portion of the base plate) because the cutout portion opens at the outer peripheral portion of the base plate, and it is difficult to apply the solder in a fillet form (i.e., a circular truncated cone form whose outer peripheral surface is concavely curved).

Although the through hole is a long hole, the solder can be applied easily and precisely because the through hole opens only at both thickness-direction ends of the base plate.

Further, because the connecting portion formed in the U-shape penetrates both the cutout portion and the through hole, relative displacement of the antenna with respect to the base plate in the direction intersecting both the direction in which the through hole and the base plate face each other and the thickness direction of the base plate can be reliably regulated.

A second aspect of the invention provides an antenna device comprising: an antenna including a body portion that transmits or receives radio waves, and a rod-like connecting portion that extends in a predetermined direction from the body portion, with the connecting portion including a curved site that is curved at the side opposite from the body portion side; and a base plate on which an electrical circuit is disposed and in which is formed a through hole penetrated by an end portion of the curved site of the connecting portion, with the end portion being electrically connected to the electrical circuit by solder, wherein the through hole is a long hole having a major axis in the predetermined direction, and the through hole is penetrated by the end portion such that a significant clearance is disposed between an inner wall of the through hole in the predetermined direction and the end portion of the connecting portion penetrating the through hole.

As described above, the antenna device pertaining to the present invention can maintain the connection between the antenna and the base plate without unnecessary stress being applied to the antenna.

BRIEF DESCRIPTION OF THE DRAWINGS

An embodiment of the present invention will be described below with reference to the accompanying drawings, wherein.

DETAILED DESCRIPTION OF THE INVENTION

CONFIGURATION OF THE EMBODIMENT

Figure 1:
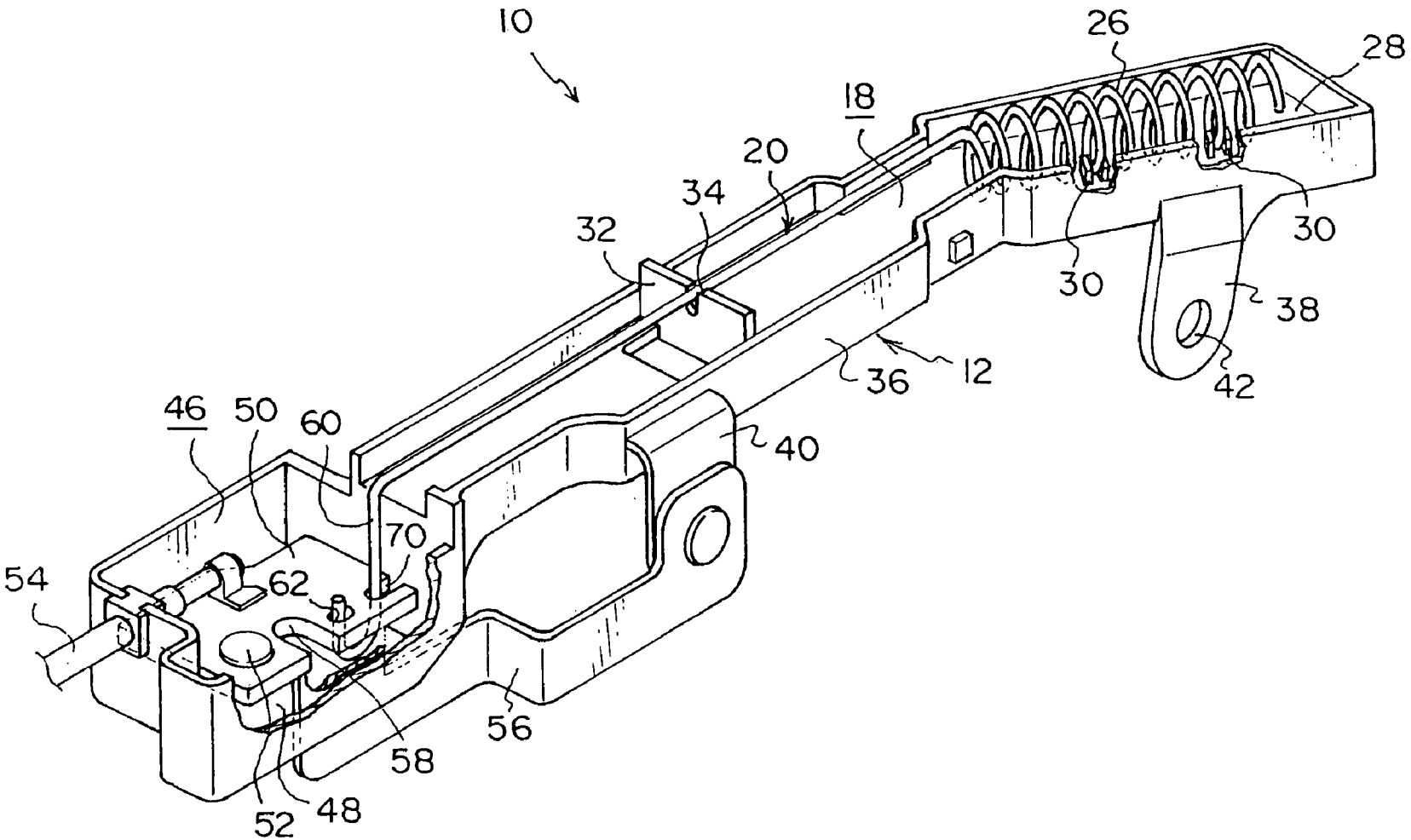
FIG. 1 is a perspective view of an antenna device pertaining to the embodiment of the invention.

The relevant portions of an antenna device 10 pertaining to an embodiment of the invention are shown in perspective view in FIG. 1.

Figure 4:
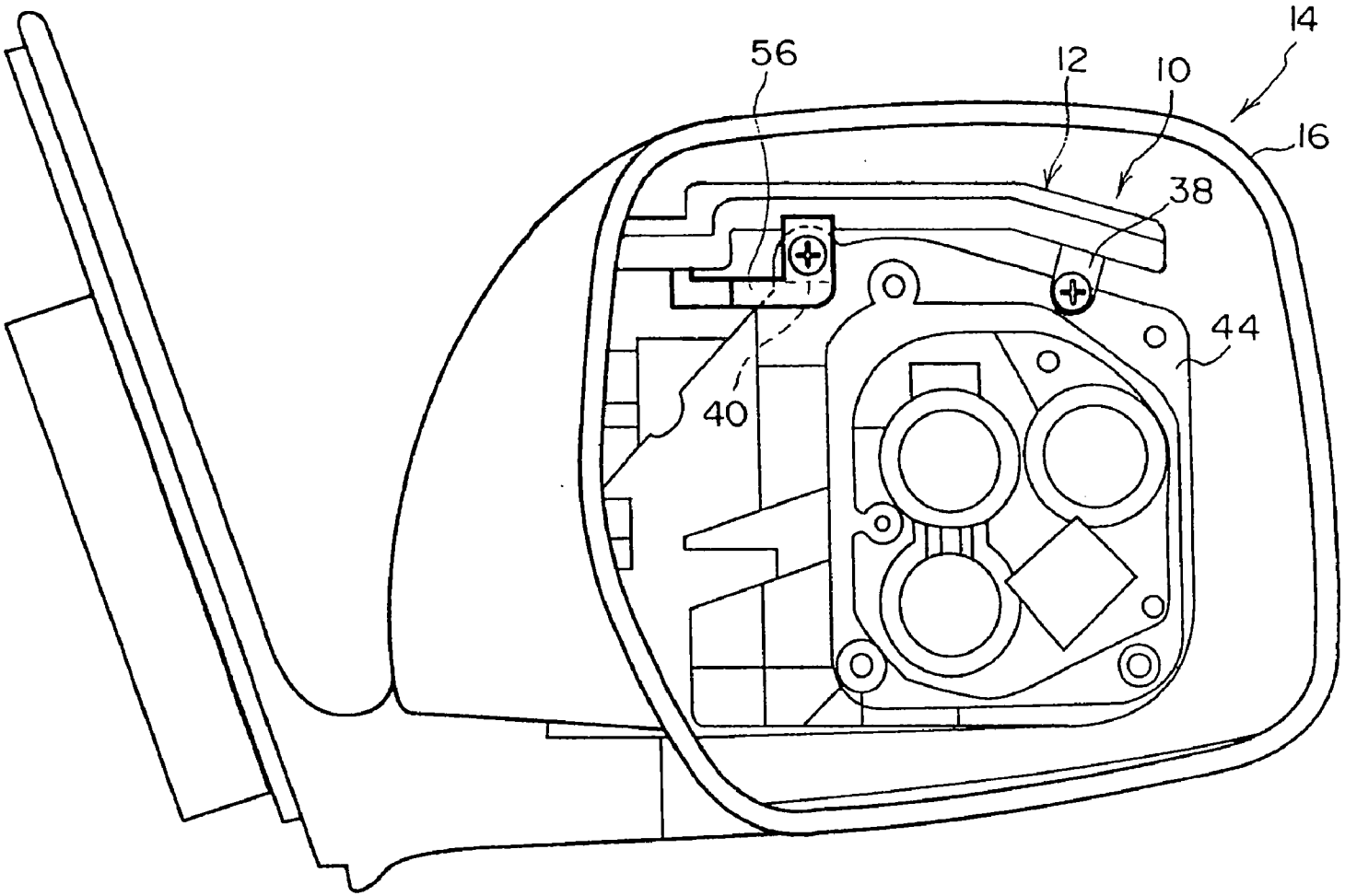
FIG. 4 is a front view of a door mirror to which the antenna device pertaining to the embodiment of the invention is attached.

As shown in FIG. 1, the antenna device 10 includes a case 12. As shown in FIG. 4, the case 12 is disposed inside a visor 16 of a door mirror 14. As shown in FIG. 1, the case 12 includes an antenna housing 18.

The antenna housing 18 is formed in a narrow box-like shape that opens substantially upward in a state where the case 12 is disposed inside the visor 16. An antenna 20 is housed inside the antenna housing 18. The antenna 20 is formed by a metal rod-like member that is long along the longitudinal direction of the antenna housing 18.

The leading end side of the antenna 20 from its intermediate portion in the longitudinal direction serves as a body portion 26. The body portion 26 is formed as a coil whose axial direction is a direction inclined substantially downward with respect to the longitudinal direction at the intermediate portion of the antenna 20.

In correspondence to the body portion 26, the leading end side of the antenna housing 18 of the case 12 from its intermediate portion is bent around an axis whose axial direction is the width direction of the case 12.

Figure 3:
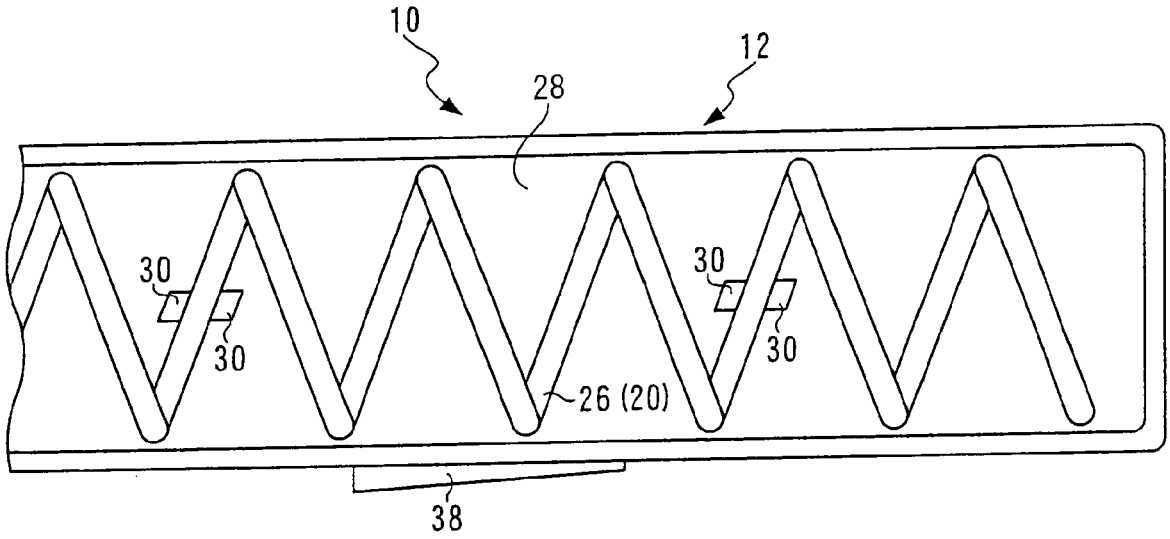
FIG. 3 is an enlarged plan view of a body portion of the antenna and its periphery.

As shown in FIG. 3, plural retaining pieces 30 serving as retaining portions are erectly disposed on a bottom wall 28 of the antenna housing 18. The body portion 26 is fitted in between these retaining pieces 30 such that displacement of the body portion 26 along the longitudinal direction of the antenna housing 18 is regulated by the retaining pieces 30.

Further, as shown in FIG. 1, a regulating piece 32 is erectly disposed on the portion of the bottom wall 28 of the antenna housing 18 housing the intermediate portion of the antenna 20. The regulating piece 32 is formed as a plate having a thickness in the longitudinal direction of the antenna housing 18.

Moreover, a cutout portion 34 is formed in the regulating piece 32. The cutout portion 34 penetrates the thickness direction of the regulating piece 32 and opens in the same direction as the open direction of the antenna housing 18 at the outer peripheral portion of the regulating piece 32.

The open width (open width dimension) of the cutout portion 34 is substantially the same size as the outer diameter dimension of the intermediate portion of the antenna 20, and the intermediate portion of the antenna 20 is fixed in the cutout portion 34. Because the intermediate portion of the antenna 20 is fixed in the inner peripheral portion of the cutout portion 34, the inner peripheral portion of the cutout portion 34 interferes with the intermediate portion of the antenna 20 when it tries to become displaced in the width direction of the antenna housing 18, whereby displacement (movement) of the antenna 20 is regulated in the width direction of the antenna housing 18.

Further, a pair of attachment pieces 38 and 40 is formed on a side wall 36 of the antenna housing 18. The attachment pieces 38 and 40 are formed as tongue pieces extending in the opposite direction of the open direction of the antenna housing 18. Through holes 42 that penetrate the width direction of the antenna housing 18 are formed in the attachment pieces 38 and 40.

A screw is inserted through the through hole 42 and screwed into the vicinity of the upper end portion of a metal (steel) frame 44 that directly or indirectly supports a mirror inside the visor 16, whereby the case 12 is fixed to the frame 44.

As shown in FIG. 1, the case 12 also includes a base plate housing 46. The base plate housing 46 is formed in a substantial box-like shape that opens in the same direction as the open direction at the intermediate portion of the antenna housing 18. However, a bottom wall 48 of the base plate housing 46 is lower than the bottom wall 28 of the antenna housing 18, so that overall the case 12 has a structure where a step is formed therein.

A base plate 50 is disposed inside the base plate housing 46. The base plate 50 is formed as a plate and has a thickness along the open direction of the base plate housing 46 (the open direction becomes the thickness direction). Unillustrated printed wiring (an electrical circuit) is disposed on the surface of the base plate 50. The base plate 50 is supported on an unillustrated support portion formed inside the base plate housing 46 in a state where the base plate 50 is separated from the bottom wall 48, and the base plate 50 is fixed with a screw 52.

The leading end of a cable 54 for supplying electrical power is fixed to the base plate 50. The cable 54 is electrically continuous with the printed wiring. A metal ground plate 56 is disposed under the base plate housing 46. One end of the ground plate 56 is fitted together with the undersurface of the case 12 and is electrically continuous with the printed wiring via the base plate 50 and the screw 52.

The other end of the ground plate 56 is appropriately bent such that it becomes adjacent to the attachment piece 40 at one side of the attachment piece 40. The ground plate 56 is positioned on one side of the attachment piece 40, the frame 44 is positioned on the other side of the attachment piece 40, and a screw is inserted through the ground plate 56, the attachment piece 40 and the frame 44, whereby the case 12 is fixed to the frame 44 as described above, and the metal ground plate 56 is electrically connected to the metal frame 44 via the screw. That is, in the present embodiment, the printed wiring of the base plate 50 is grounded via the ground plate 56, the screw and the frame 44.

A cutout portion 70 is formed in the base plate 50. The cutout portion 70 opens at the portion of the outer peripheral portion of the base plate 50 near the antenna housing 18, and penetrates the thickness direction of the base plate 50.

Figure 2:
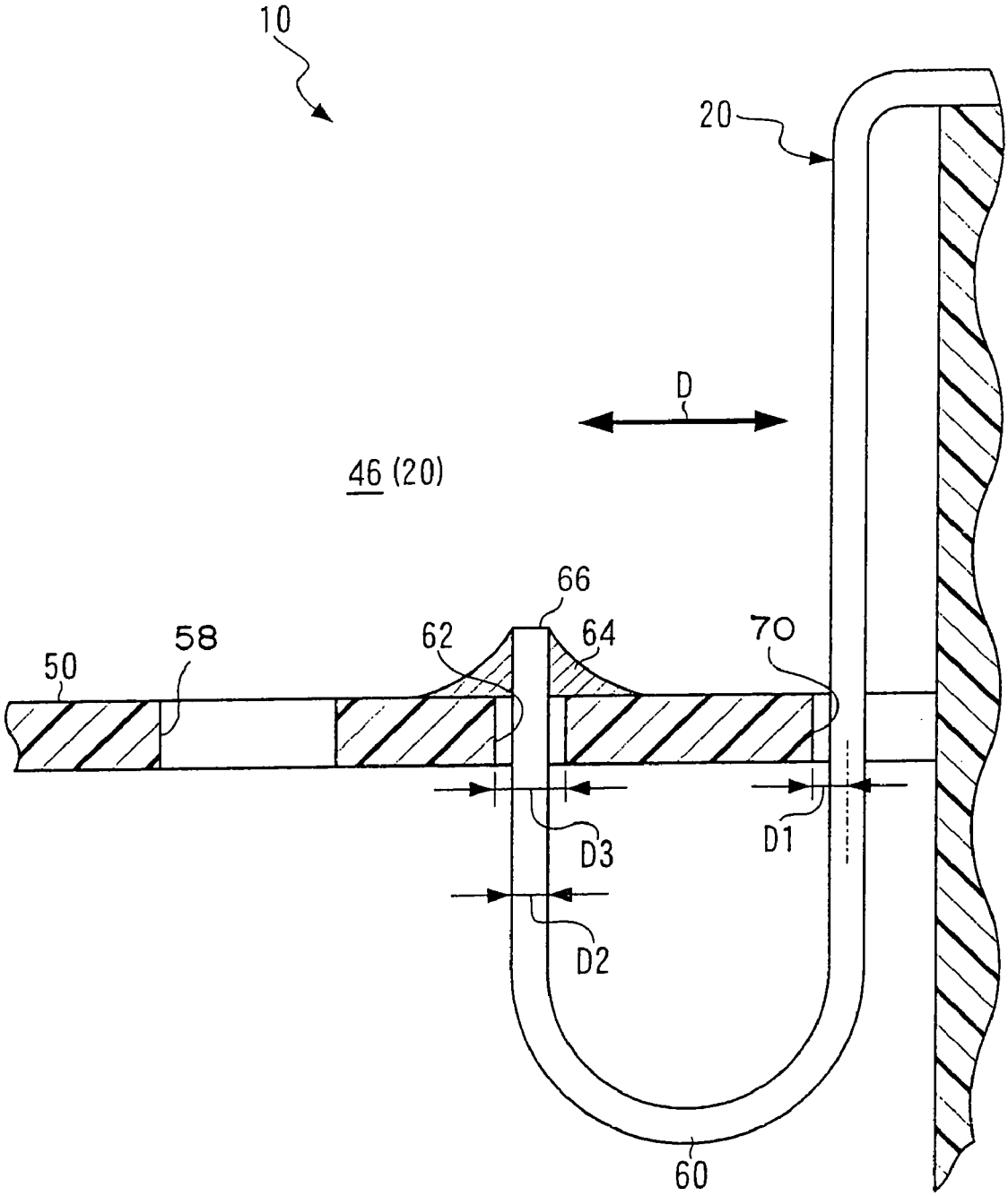
FIG. 2 is an enlarged front sectional view of the relevant portions of the antenna device pertaining to the embodiment of the invention.

In correspondence to the cutout portion 70, a U-shaped portion 60 serving as a connecting portion is formed on the end portion of the antenna 20 opposite from the body portion 26 of the connecting portion (intermediate portion) of the antenna 20. As shown in FIG. 2, the U-shaped portion 60 is formed by bending, at a substantial right angle toward the bottom plate 48, the portion of the antenna 20 entering the base plate housing 46 and then curving this bent portion in a U-shape away from the bottom wall 48 at the undersurface side of the base plate 50.

As shown in FIG. 1, part of the U-shaped portion 60 passes through the inside of the cutout portion 70. Here, the cutout portion 70 is cut out deeper than a preset passing position where the U-shaped portion 60 passes through the inside of the cutout portion 70. A distance D1 from the end portion (bottom portion) of the cutout portion 70—that is, the portion at the side of the cutout portion 70 opposite from the open side of the outer peripheral portion of the base plate 50—to the center of the preset passing position of the U-shaped portion 60 is set such that it is substantially equal to an outer diameter dimension D2 of the antenna 20 at the U-shaped portion 60.

For this reason, when the U-shaped portion 60 passes through the cutout portion 70 at the preset passing position, a clearance having a size that is at least substantially half of the outer diameter dimension D2 of the U-shaped portion 60 is formed between the outer peripheral portion of the U-shaped portion 60 and the end portion (bottom portion) of the cutout portion 70.

Moreover, as shown in FIG. 2, a base end portion 66 (the end portion opposite from the portion connected to the intermediate portion of the antenna 20) of the U-shaped portion 60 passes from the undersurface side of the base plate 50 through a through hole 62 serving as a penetrating portion formed in the base plate 50, and protrudes at the surface of the base plate 50.

Here, an open dimension D3 of the through hole 62 along the open width direction (direction of arrow D in FIG. 2) of the U-shaped portion 60 is substantially twice the outer diameter dimension D2 of the U-shaped portion 60. When the U-shaped portion 60 passes through the through hole 62 at a preset passing position, the U-shaped portion 60 passes through the substantial center of the through hole 62.

However, as described above, because the open dimension of the through hole 62 along the open width direction (direction of arrow D) of the U-shaped portion 60 is greater than the outer diameter dimension D2 of the U-shaped portion 60, the U-shaped portion 60 can be displaced (can move) inside the through hole 62 along the open width direction of the through hole 62.

Moreover, as described above, in a state where the U-shaped portion 60 has passed through the cutout portion 70 at the preset position, a clearance having a size that is at least substantially half of the outer diameter dimension D2 of the U-shaped portion 60 is formed between the outer peripheral portion of the U-shaped portion 60 and the end portion (bottom portion) of the cutout portion 70. For this reason, even if the U-shaped portion 60 is displaced inside the through hole 62 in the open width direction of the through hole 62, the end portion (bottom portion) of the cutout portion 70 does not obstruct the displacement of the U-shaped portion 60.

Further, as shown in FIG. 2, solder 64 is applied to the surface of the base plate 50 around the base end portion 66 of the U-shaped portion 60, such that the base end portion 66 of the U-shaped portion 60 is mechanically joined to the base plate 50 and electrically connected to the printed wiring on the base plate 50 by the solder 64.

Moreover, as shown in FIG. 1, a passing portion 58 is formed in the base plate 50 opposite from the cutout portion 70 with the through hole 62 therebetween. The passing portion 58 penetrates the base plate 50 (along the thickness direction of the base plate 50) and is formed as a cutout that opens at part of the outer periphery of the base plate 50.

ACTION AND EFFECTS OF THE EMBODIMENT

Next, the action and effects of the antenna device 10 will be described.

In the antenna device 10, when the body portion 26 of the antenna 20 receives radio waves, such as a signal outputted from a transmitter (not shown) attached to the inside of a tire of the vehicle, the signal is inputted via the cable 54 to a control device (not shown) disposed in the vehicle. In the control device, the inputted electrical signal is processed, and when the air pressure of the tire based on the level of the electrical signal has fallen below a predetermined constant value, the control device activates an alarm device (not shown) and notifies the passenger of the vehicle with an alarm.

Further, when the antenna device 10 is assembled, the antenna 20 is positionally fixed to the retaining pieces 30, the cutout portion 34, and the unillustrated support portion formed inside the base plate housing 46. In this manner, in the antenna device 10, the antenna 20 is positioned with respect to the frame 44, whereby fluctuations in the gain of the antenna 20 resulting from the positional relationship between the antenna 20 and the frame 44 and the various devices of the door mirror 14 attached to the frame 44 can be effectively suppressed.

Next, the base plate 50 is housed in the base plate housing 46 of the case 12 in a state where the leading end portion of the cable 54 is mechanically and electrically connected to the base plate 50. When the base plate 50 is housed inside the case 12 in this manner, the end portion of the cutout portion 70 approaches the end portion of the U-shaped portion 60 (the end portion at the body portion 26 side of the antenna 20) from the open side (or the direction in which the surface of the base plate 50 is inclined at the open side) above the U-shaped portion 60, and the inner surface of the through hole 62 formed as a long hole approaches the other end of the U-shaped portion 60.

Both ends of the U-shaped portion 60 penetrate the cutout portion 70 and the through hole 62 as a result of the cutout portion 70 and the through hole 62 approaching both ends of the U-shaped portion 60 in this manner.

In this manner, the base plate 50 disposed inside the base plate housing 46 is fixed to the case 12 by fixing means such as a screw.

Here, as described above, the body portion 26 of the antenna 20 is formed as a coil, and the U-shaped portion 60 is formed by bending and curving the antenna 20. Thus, slight error arises in the position of the end portion of the U-shaped portion 60 with respect to the body portion 26. Slight error also arises in the forming position of the through hole 62 that the base end of the U-shaped portion 60 penetrates.

Thus, error arises in the interval (distance) between the position of a hole through which a screw is inserted in order to fix the base plate 50 and the portions where the body portion 26 is retained in the retaining pieces 30.

Here, in the present embodiment, even if such error arises, when the base plate 50 is to be set inside the base plate housing 46, the U-shaped portion 60 does not pass through the cutout portion 70 and the through hole 62 at the preset position; rather, the U-shaped portion 60 passes through the cutout portion 70 and the through hole 62 at a position displaced toward the open side of the cutout portion 70 or toward the opposite side with respect to the preset position.

In this manner, even if the above error arises, the U-shaped portion 60 only passes through the cutout portion 70 and the through hole 62 at the position displaced toward the open side of the cutout portion 70 or the opposite side with respect to the preset position. For this reason, force (stress) does not act on the U-shaped portion 60, and the U-shaped portion 60 does not become deformed. Thus, the above error is absorbed and no fluctuations arise in the characteristics of the antenna 20.

Moreover, as described above, because the base plate 50 can be set in the case 12 without stress acting on the U-shaped portion 60, stress does not act on the solder 64 even when the end portion 66 (the portion penetrating the through hole 62) of the U-shaped portion 60 is joined to the base plate 50 with the solder 64 in a state where the antenna 20 and the base plate 50 have been set in the case 12. Thus, cracks do not arise in the solder 64 when the base plate 50 and the antenna 20 are housed in the case 12. Thus, in the antenna device 10, the mechanical and electrical connection between the antenna 20 and the base plate 50 can be excellently maintained over a long period of time.

Further, in the antenna device 10, because the end portion 66 of the U-shaped portion 60 passed through the through hole 62 protrudes at the surface of the base plate 50 in this manner, the solder 64 can be applied to the surface of the base plate 50. Thus, even in a state where the base plate 50 and the antenna 20 have been disposed in the case 12, the position where the solder 64 is to be applied is not hidden by the base plate 50, and the work of applying the solder can be made easy.

It will be noted that the antenna device 10 may also be configured such that a rod-like connecting portion that is linear along the thickness direction of the base plate 50 is disposed instead of the U-shaped portion 60, and the solder 64 is applied to the connecting portion penetrating the cutout portion 70.

However, with this configuration, it is difficult to precisely apply the solder 64 to the passing portion of the connecting portion; for example, it becomes easy for the solder 64 to flow toward the open side of the cutout portion 70 when the solder 64 is melted because the cutout portion 70 opens at the outer peripheral portion of the base plate 50, and it is difficult to apply the solder 64 in a fillet form, which is a circular truncated cone form whose outer peripheral surface is concavely curved.

In contrast, in the present embodiment, the molten solder 64 very seldom flows toward the outer peripheral side of the base plate 50 because the through hole 62 around which the solder 64 is applied opens only at both sides of the base plate 50, even though the through hole 62 is a long hole. Thus, the solder 64 can be easily and precisely applied.

Further, because the U-shaped portion 60 penetrates both the cutout portion 70 and the through hole 64, the inner peripheral portions of the cutout portion 70 and the through hole 64 regulate the displacement of the antenna 20 even if the antenna 20 tries to become displaced with respect to the base plate 50 in the direction intersecting both the thickness direction of the base plate 50 and the direction connecting the cutout portion 70 and the through hole 64. Thus, shifting of the antenna 20 with respect to the base plate 50 can be effectively prevented.

Moreover, because the antenna device 10 is disposed inside the visor 16 of the door mirror 14, rust resulting from water when it rains or when the vehicle is washed and adhering to the base plate 50, the cable 54, or the solder 64 applied to the base plate 50 and the antenna 20 can also be prevented by so-called "potting," where the inside of the base plate housing 46 is filled with an urethane resin material and the base plate 50 is embedded in the synthetic resin material.

Here, in the antenna device 10, the passing portion 58 formed in the base plate 50 penetrates the thickness direction of the base plate 50 and is formed as a cutout that opens at part of the outer periphery of the base plate 50. For this reason, when the inside of the base plate housing 46 is filled with substantially liquefied synthetic resin material from the open side of the base plate housing 46, the synthetic resin material passes smoothly through the passing portion 58 such that it fills the space between the base plate 50 and the bottom wall 48. In this manner, in the antenna device 10, the working efficiency of doing the potting can be improved because the work of filling the inside of the base plate housing 46 with the synthetic resin material can be conducted smoothly and quickly.

In the present embodiment, the open dimension of the through hole 62 along the open width direction of the U-shaped portion 60 was about twice the outer diameter dimension of the U-shaped portion 60, but the open dimension of the through hole 62 along the open width direction of the U-shaped portion 60 is not limited to this size. Specifically, it suffices for the open dimension of the through hole 62 along the open width direction of the U-shaped portion 60 to be sufficiently larger than the outer diameter dimension of the U-shaped portion 60, and the size may be appropriately set in accordance with the outer diameter dimension of the U-shaped portion 60, for example.

What is claimed is:

1. An antenna device comprising:

an antenna including a body portion that transmits or receives radio waves and a rod-like connecting portion that is contiguous with the body portion; and a base plate disposed with an electrical circuit on at least one of its surface and undersurface, wherein a penetrating portion through which the connecting portion passes is formed in the base plate in the thickness direction of the base plate, the penetrating portion has an open dimension that is larger than an outer diameter dimension of the connecting portion along a direction moving toward and away from the body portion, and the connecting portion passed through the penetrating portion is electrically connected to the electrical circuit by solder at the surface or the undersurface of the base plate.

2. The antenna device of claim 1, further comprising a case that internally houses both the base plate and the antenna and includes a positioning portion that engages with and positions the antenna.

3. The antenna device of claim 1, wherein the connecting portion includes a site that is bent or curved in a U-shape opening in the thickness direction of the base plate, with the connecting portion being contiguous with the body portion at one end side of the site, the base plate includes a cutout portion that opens at the body portion side of the outer peripheral portion of the base plate and penetrates the thickness direction of the base plate, with the cutout portion having a dimension along the direction moving toward and away from the body portion that is sufficiently larger than the outer diameter dimension of the connecting portion, and with the one end side of the site passing through the cutout portion, and a through hole that penetrates the thickness direction of the base plate and through which the other end side of the site passes from the undersurface side, with the through hole having an open dimension from the one end to the other end of the site that is sufficiently larger than the outer diameter dimension of the connecting portion, and the penetrating portion includes the through hole.

4. The antenna device of claim 1, wherein the open dimension of the penetrating portion is substantially twice the outer diameter dimension of the connecting portion.

5. The antenna device of claim 1, wherein the connecting portion includes a site that is bent or curved substantially perpendicular to the direction moving toward and away from the body portion.

6. The antenna device of claim 2, wherein the site of the case housing the base plate is filled with urethane resin.

7. The antenna device of claim 3, wherein the open dimension of the through hole is substantially twice the outer diameter dimension of the connecting portion.

8. An antenna device comprising:

an antenna including a body portion that transmits or receives radio waves, and a rod-like connecting portion that extends in a predetermined direction from the body portion, with the connecting portion including a curved site that is curved at the side opposite from the body portion side; and a base plate on which an electrical circuit is disposed and in which is formed a through hole penetrated by an end portion of the curved site of the connecting portion, with the end portion being electrically connected to the electrical circuit by solder, wherein the through hole is a long hole having a major axis in the predetermined direction, and the through hole is penetrated by the end portion such that a significant clearance is disposed between an inner wall of the through hole in the predetermined direction and the end portion of the connecting portion penetrating the through hole.

9. The antenna device of claim 8, wherein the curved site has a substantial U-shape.

10. The antenna device of claim 8, wherein the curved site has a substantial U-shape, the base plate includes a cutout portion that opens at a body portion side end surface and extends in the predetermined direction, and the curved site penetrates the cutout portion such that the cutout portion has a significant clearance between its inner wall surface in the predetermined direction and the curved site penetrating the inside of the cutout portion.

11. The antenna device of claim 8, further comprising a case that internally houses both the base plate and the antenna and includes a positioning portion that engages with and positions the antenna.

12. The antenna device of claim 11, wherein the site of the case housing the base plate is filled with urethane resin.

* * * * *